US009318126B2

(12) United States Patent
Shidoji et al.

(10) Patent No.: US 9,318,126 B2
(45) Date of Patent: Apr. 19, 2016

(54) VOICE CLARIFICATION APPARATUS

(71) Applicant: YAMAHA CORPORATION, Hamamatsu-shi, Shizuoka-ken (JP)

(72) Inventors: Hiroomi Shidoji, Hamamatsu (JP); Ryotaro Aoki, Hamamatsu (JP)

(73) Assignee: YAMAHA CORPORATION, Hamamatsu-shi (JP)

( * ) Notice: Subject to any disclaimer, the term of this patent is extended or adjusted under 35 U.S.C. 154(b) by 537 days.

(21) Appl. No.: 13/723,899

(22) Filed: Dec. 21, 2012

(65) Prior Publication Data

US 2013/0173262 A1 Jul. 4, 2013

(30) Foreign Application Priority Data

Dec. 28, 2011 (JP) ..... 2011-287793

(51) Int. Cl.
*G10L 21/00* (2013.01)
*G10L 19/00* (2013.01)
*G10L 21/0364* (2013.01)

(52) U.S. Cl.
CPC ..... *G10L 21/0364* (2013.01)

(58) Field of Classification Search
CPC ... G10L 19/265; G10L 19/00; G10L 19/0204; G10L 21/038; G10L 25/18; G10L 25/84; G10L 21/0205; G10L 21/028
USPC ..... 704/200.1, 500, 501, 502, 503, 504, 704/205, 210, 225
See application file for complete search history.

(56) References Cited

U.S. PATENT DOCUMENTS 7,389,093 B2 * 6/2008 Kunito ..... H04M 1/2535 375/295
7,539,613 B2 * 5/2009 Takada ..... G10L 21/038 330/278
7,805,293 B2 * 9/2010 Takada ..... G10L 21/0364 330/278
2005/0055202 A1 * 3/2005 Kunito ..... H04M 1/2535 704/225
2006/0142999 A1 * 6/2006 Takada ..... G10L 21/0364 704/205
2008/0040104 A1 * 2/2008 Ide ..... G10L 19/087 704/219

FOREIGN PATENT DOCUMENTS

JP 06-289898 A 10/1994
JP 7-42236 U 7/1995
JP 11-308484 A 11/1999
JP 2005-229544 A 8/2005
JP 4013906 B 11/2007
JP 2008-145940 A 6/2008
JP 2010-028515 A 2/2010

OTHER PUBLICATIONS

Notice of Reasons for Rejection for corresponding JP 2011-287793, mail date Nov. 19, 2013. English translation provided.

* cited by examiner

*Primary Examiner* — Edgar Guerra-Erazo
(74) *Attorney, Agent, or Firm* — Rossi, Kimms & McDowell LLP

(57) ABSTRACT

The voice clarification apparatus includes a plurality of band-pass filters that respectively extract a plurality of band components, which are included in a voice band, from an input audio signal; a gain determination unit that determines a gain according to the level of a signal of a band component which is extracted by at least one band-pass filter of the plurality of band-pass filters; a level adjustment unit that adjusts the levels of signals of the plurality of band components which are extracted by the plurality of band-pass filters using the gain; and a first addition unit that adds a signal which is based on the audio signal to a signal in which the gain is adjusted by the level adjustment unit, and outputs a signal obtained through the addition.

9 Claims, 8 Drawing Sheets

FIG. 5

| MODE | GAIN | | |
|---|---|---|---|
| | K1 | K2 | K3 |
| A | k1a | k2a | k3a |
| B | k1b | k2b | k3b |
| C | k1c | k2c | k3c |
| D | k1d | k2d | k3d |
| ⋮ | ⋮ | ⋮ | ⋮ |

VOICE CLARIFICATION APPARATUS

BACKGROUND OF THE INVENTION

1. Field of the Invention

The present invention relates to technology which improves the clarity of sound included in an audio signal.

Priority is claimed on Japanese Patent Application No. 2011-287793, filed on Dec. 28, 2011, the content of which is incorporated herein by reference.

2. Description of Related Art

When an audio signal, representing, for example, a movie or music, is played in the middle of the night, there are many cases in which the volume is turned down in consideration of neighbors. If the audio file, which is supplied from a source, has a low volume when the volume is turned down, it is difficult to hear reproduced sound. In particular, if volume is turned down when a movie is reproduced, it is difficult to hear low sound such as words because the range of volume (a dynamic range) is wide. In addition, if volume is turned up such that sound such as words or narration are easily heard, sound effects are reproduced at a high volume.

Here, technology has been proposed which compresses the dynamic range of the audio signal of a channel having a large number of voice components and corrects defects in which the voice components are buried in the volume of the audio signal of another channel after the compression is performed (for example, refer to Japanese Patent No. 4013906).

However, in this technology, if an audio signal includes a large number of components, such as sound effects or Background Music (BGM), in addition to voices, sounds are emphasized in addition to the voices, and thus the voices are not clear.

SUMMARY OF THE INVENTION

The present invention has been made in consideration of the above problems in the related art and an object thereof is to provide a voice clarification apparatus which enables voices to be easily heard and components other than the voices to be naturally reproduced.

In order to accomplish the above object, there is provided a voice clarification apparatus including: a plurality of band-pass filters that respectively extract a plurality of band components, which are included in a voice band, from an input audio signal; a gain determination unit that determines a gain according to a level of a signal of a band component which is extracted by at least one band-pass filter of the plurality of band-pass filters; a level adjustment unit that adjusts levels of signals of the plurality of band components which are extracted by the plurality of band-pass filters using the gain; and a first addition unit that adds a signal which is based on the audio signal to a signal in which a gain is adjusted by the level adjustment unit, and outputs a signal obtained through the addition.

According to the present invention, the level of a signal of a band component included in a voice band is adjusted using a gain according to the level of the signal, and then the signal is added to the original audio signal. Therefore, it is possible to make voices clearer and to prevent components other than voices from being excessively emphasized.

In the present invention, it is preferable that the gain determination unit include a conversion unit which converts input levels based on a signal indicative of voice components into a gain which has predetermined input and output characteristics, and it is preferable that the conversion unit output the gain which is greater than "1" when an absolute value of a level of the signal indicative of the voice components is equal to or less than a threshold, and output the gain which is smaller than "1" when the absolute value is greater than the threshold. Further, in this configuration, an aspect in which the conversion unit changes the input and output characteristics according to setting information used to set volume may be used. According to this aspect, it is possible to increase or decrease the emphasis of the voice components according to the setting information.

In the present invention, it is preferable that the plurality of band-pass filters include a first band-pass filter which extracts a first frequency band included in the voice band of the audio signal, and a second band-pass filter which extracts a second frequency band which is higher than the first frequency band in the voice band of the audio signal, and it is preferable that the voice clarification apparatus further include: a first multiplier that multiplies the level of a signal extracted by the first band-pass filter by a first gain coefficient; a second multiplier that multiplies the level of a signal extracted by the second band-pass filter by a second gain coefficient; and a second addition unit that adds the signal which is output from the first multiplier to the signal which is output from the second multiplier, and outputs a resulting signal.

According to this configuration, the level of the signal having the first frequency band included in the voice band is multiplied by the first gain coefficient, the level of the signal having the second frequency band included in the voice band is multiplied by the second gain coefficient, the results are added to each other, thereby generating a signal in which sound is clarified. In addition, it is preferable that the first frequency band and the second frequency band are bands corresponding to the formants of voice.

Further, in the above configuration, it is preferable that the voice clarification apparatus further include: a storage unit that stores a plurality of sets of the first gain coefficient and the second gain coefficient in advance; and a setting unit that selects any one of the plurality of sets, and supplies a first gain coefficient of the selected set to the first multiplier, and a second gain coefficient of the selected set to the second multiplier.

According to this aspect, it is possible to appropriately clarify voices according to the characteristics and type of audio signal.

BRIEF DESCRIPTION OF THE DRAWINGS

FIG. 5 is a table illustrating coefficients which are set in the second embodiment of the present invention.

DETAILED DESCRIPTION OF THE INVENTION

Hereinafter, voice clarification apparatuses according to embodiments of the present invention will be described with reference to the accompanying drawings.

First Embodiment

Figure 1:
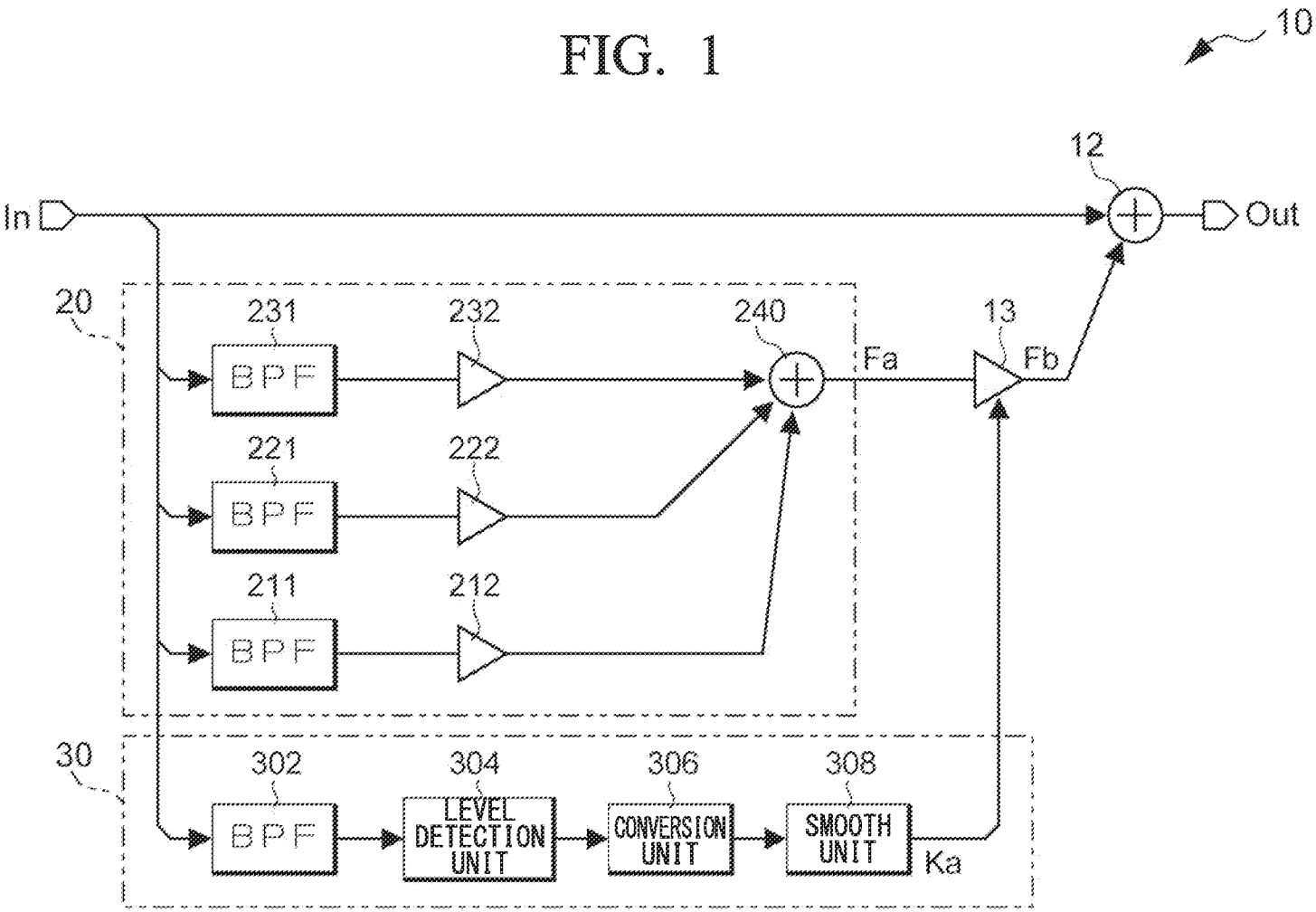
FIG. 1 is a block diagram illustrating a voice clarification apparatus according to a first embodiment of the present invention.

FIG. 1 is a block diagram illustrating a voice clarification apparatus according to a first embodiment of the present invention, and shows a configuration which is necessary to process an audio signal for a single channel. Therefore, in a case of multi-channels, the configuration shown in FIG. 1 is applied according to the number of channels. In addition, in the present embodiment, it is assumed that a signal is a digital signal if there is no specific description.

As shown in FIG. 1, a voice clarification apparatus 1 includes an adder 12, a multiplier 13, a voice band extraction unit 20, and a gain determination unit 30. An audio signal In to be processed is supplied to each of the voice band extraction unit 20 and the gain determination unit 30.

The voice band extraction unit 20 is used to extract three components in a voice band from the audio signal In, and includes Band Pass Filters (BPFs) 211, 221, and 231, multipliers 212, 222, and 232, and an adder 240.

Here, the BPF 211 has a pass-band in the range of approximately 200 to 500 Hz, and extracts the first formant component of voice from the audio signal In. The BPF 221 has a pass-band in the range of approximately 2 to 3 kHz, and extracts the second formant component of voice from the audio signal In. The BPF 231 has a pass-band in the range of approximately 4 to 12 kHz, and extracts harmonic components, which is two to four times the frequency of the second formant, from the audio signal In.

The multiplier 212 multiplies the output signal of the BPF 211 by a preset gain coefficient and outputs a resulting signal. In the same manner, the multipliers 222 and 232 respectively multiply the output signals of the BPFs 221 and 231 by preset gain coefficients and output resulting signals. In addition, when the process is performed using an analog signal, the respective multipliers 212, 222, and 232 may be used as gain amplifiers.

The adder 240 which functions as a second addition unit adds signals which are respectively output from the multipliers 212, 222, and 232 to each other, and outputs a resulting signal Fa.

Here, since the respective pass-bands of the BPFs 211, 221, and 231 are set as described above, the respective pass-bands are completely separated from each other. It can be assumed that the general forms of the frequency characteristics obtained by the three BPFs have peaks (mountains) in the center frequencies of the respective pass-bands and have bottoms (valleys) between the peaks.

The gain determination unit 30 is used to determine a gain of the signal Fa according to the levels of the voice components of the audio signal In, and includes a BPF 302, a level detection unit 304, a conversion unit 306, and a smoothing unit 308. The BPF 302 has a pass-band in the range of approximately 125 to 175 Hz, and extracts a signal indicative of the volume of voice components of the audio signal In. The reason for this is that it is experimentally certified that there is a high probability that the frequency component of voice is included in the band.

In addition, the pass-band of the BPF 302 approximately corresponds to the vibration frequency of a vocal cords in conversation. Since voice is generated in such a way that the vibration of the vocal cords resonates in the vocal tract, the vibration frequency component of the vocal cords is the source of the voice, and can be used as one index indicative of the volume of the voice component.

The level detection unit 304 detects and outputs the maximum value of a level of a signal (the maximum value based on an absolute value) which is output from the BPF 302 at every predetermined interval. The level detection unit 304 outputs the maximum value of the level of the signal obtained by the BPF 302, for example, every 5 milliseconds.

In addition, if the process allows, the level detection unit 304 may output an absolute value for every single sample instead of every 5 milliseconds. Further, the level detection unit 304 is not limited to the maximum value of the level of the signal output from the BPF 302 and may obtain and output an effective value (a root-mean-square value) or an envelope (an envelope curve). In any case, a configuration in which the level detection unit 304 outputs a level based on a signal indicative of the voice components may be used.

The conversion unit 306 converts the signal (the maximum value) which is output from the level detection unit 304 into a gain in regard to the signal Fa.

Figure 2:
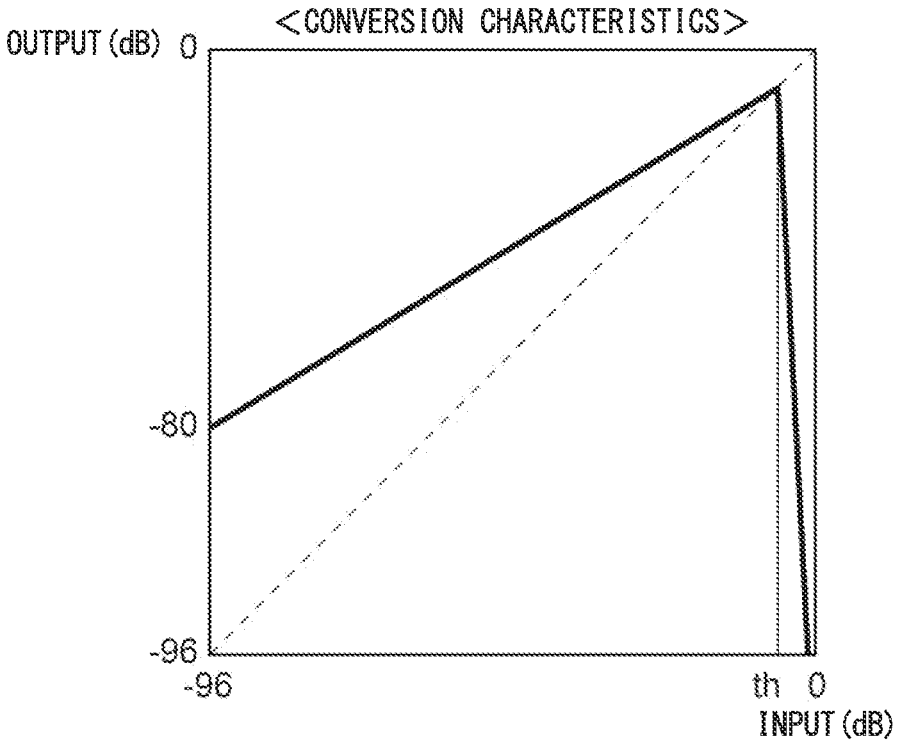
FIG. 2 is a graph illustrating the input and output characteristics of the conversion unit of the voice clarification apparatus according to the first embodiment of the present invention.

FIG. 2 is a view illustrating the input and output characteristics of the conversion unit 306 using a solid line. In the drawing, a horizontal axis is a level which is input to the conversion unit 306, that is, the level of the signal (the maximum value) which is output from the level detection unit 304, and a vertical axis indicates a level which is output from the conversion unit 306. Here, the gain, which is shown using a ratio of an output level to an input level of the conversion characteristics, is output from the conversion unit 306. In addition, a dotted line in the drawing indicates a case in which the input level is the output level as it is.

In the input and output characteristics of the conversion unit 306, a region in which the input level is equal to or less than a threshold th is characterized in that the gain is equal to or greater than "1", that is, the gain is on the upper side of the dotted line, and that the gain increases as the input level becomes smaller. Meanwhile, a region in which the input level is greater than the threshold th, is characterized in that the gain is less than "1", and the gain rapidly decreases as the input level becomes larger.

Therefore, in the region in which the input level is equal to or less than the threshold th, a gain which causes the output level to increase is output. In the region in which the input value is greater than the threshold th, a gain which causes the output level to decrease is output.

As will be described later, the signal Fa is configured such that the gain thereof is adjusted and the gain-adjusted signal Fa is added to the audio signal In. When the input level is greater than the threshold th, the volume of a voice signal included in the audio signal In is sufficiently high. Therefore, in the above-described configuration, a gain which causes the output level to decrease is output in order to suppress the emphasis of sound.

The conversion unit 306 may be configured such that the characteristics as shown in FIG. 2 are stored in a table in advance, and a gain corresponding to the input level is read with reference to the table. The conversion unit 306 may also be configured such that the above-described characteristics are defined as a function and the gain corresponding to the input level can be obtained by substituting the input level as a parameter of the function.

Here, if the level detection unit 304 outputs a maximum value at every predetermined interval (in the above example, every 5 milliseconds), the conversion unit 306 outputs a gain at the same interval corresponding to the maximum value, and thus the gain changes at every predetermined interval. Here, the smoothing unit 308 smoothes the gain which changes at every predetermined interval, and outputs a gain Ka. The smoothing is realized by a moving average or a low pass filter.

The multiplier 13 which is a level adjustment unit multiplies the signal Fa which is the output of the voice band extraction unit 20 by the gain Ka which is the output of the gain determination unit 30, and supplies a resulting signal to the input terminal of the other side of the adder 12 as a signal Fb.

The adder 12 which is a first addition unit adds the audio signal In to the signal Fb which is obtained by the multiplier 13, and outputs a resulting signal as a signal Out which is obtained by the voice clarification apparatus 1.

Generally, it is regarded that voice is clear as the ratio of the peak level of formant to the bottom level between a formant and another formant is high (for example, refer to Japanese Unexamined Patent Application, First Publication No. 2008-145940).

In the voice clarification apparatus 1 according to the present embodiment, the signal Fa which is extracted by the voice band extraction unit 20 corresponds to the voice components included in the audio signal In, more specifically, the first formant component, the second formant component, and the harmonic component of the second formant. Level adjustment is performed on the signal Fa by the gain Ka which is the output of the gain determination unit 30, the level-adjusted signal Fa is output as the signal Fb, and at the same time, as well as the signal Fb is added to the audio signal In by the adder 12, and a resulting signal is output.

In such a configuration, when the levels of the voice components included in the audio signal In are low, the gain Ka is raised such that the output level rises. Therefore, the peak level of each of the formants is raised relative to the bottom level thereof, and the signal Fb is dominant over the audio signal In, and thus voices are clarified.

On the other hand, when the levels of the voice components are sufficiently high, the gain Ka is not raised. Therefore, since the signal Fb which is added to the audio signal In is small (or 0), the emphasis of voice is also small (or 0).

In addition, in the above-described embodiment, the voice band extraction unit 20 is configured to include three BPFs in total, that is, the BPF 211 which extracts the first formant, the BPF 221 which extracts the second formant, and the BPF 231 which extracts the harmonic component of the second formant. However, the present invention is not limited thereto and the voice band extraction unit may be configured to include two BPFs. For example, even when the first formant component and the second formant component are emphasized, a vowel sound may be easily heard by the two BPFs 211 and 221, and the second formant component and the harmonic component of the second formant component may be emphasized by the two BPFs 221 and 231. Further, the two BPFs 211 and 231 may be used. Meanwhile, in addition to the BPFs 211, 221, and 231, a BPF which passes another band may be added, thereby using four or more BPFs.

Alternatively, a part corresponding to the valley between the first formant and the second formant may be emphasized in such a way as to provide a BPF which passes a band between the BPF 211 and the BPF 221 and a multiplier which greatly attenuates the output of the BPF, and in such a way as to add the output of the multiplier to an addition target of the adder 240.

Second Embodiment

Figure 3:
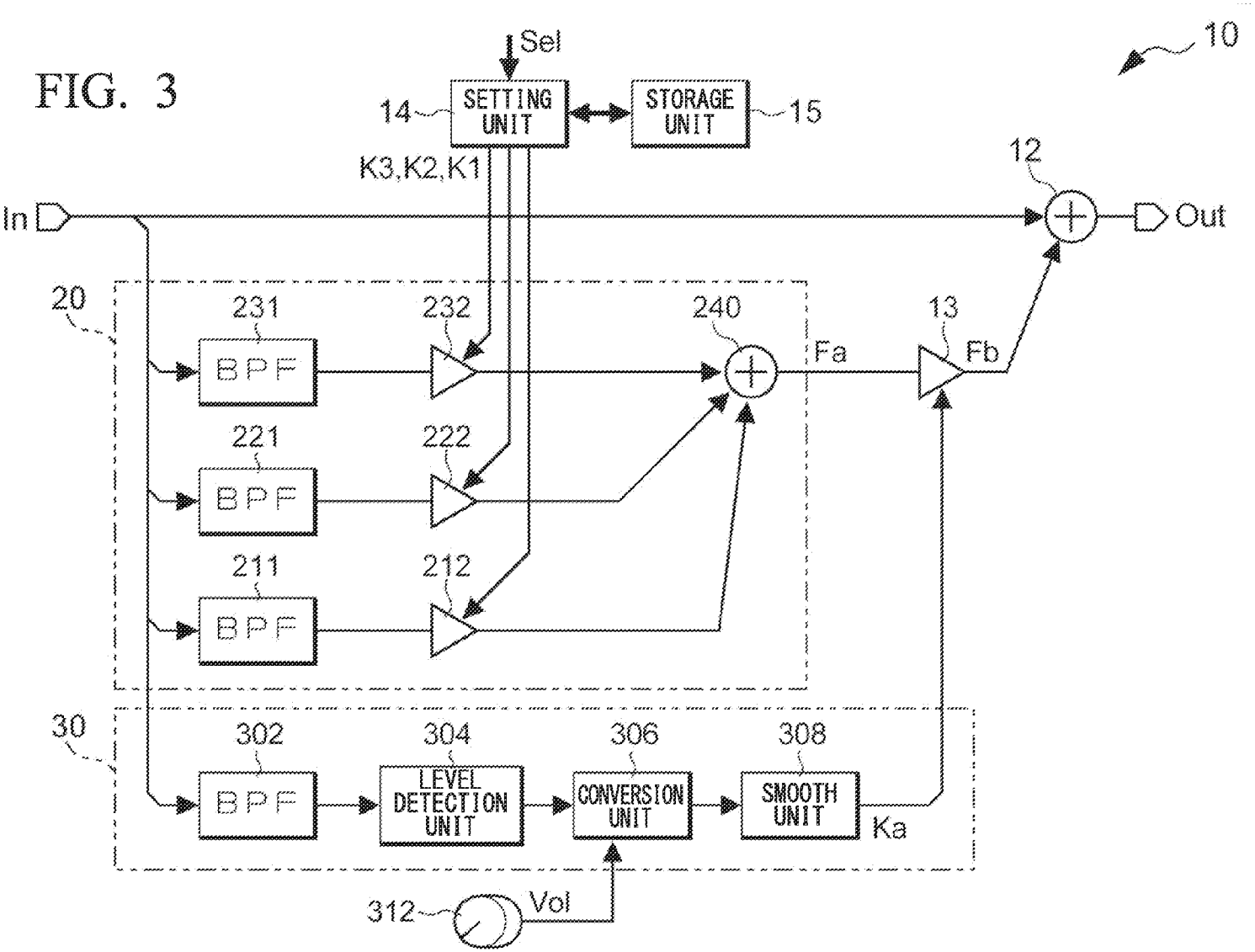
FIG. 3 is a block diagram illustrating a voice clarification apparatus according to a second embodiment of the present invention.

The present invention is not limited to the above-described embodiment. For example, various types of modifications which will be described below are possible. FIG. 3 is a block diagram illustrating the configuration of a voice clarification apparatus according to a second embodiment. Further, among various types of embodiments which will be described below, a randomly selected one or more embodiments may be appropriately combined.

Figure 4:
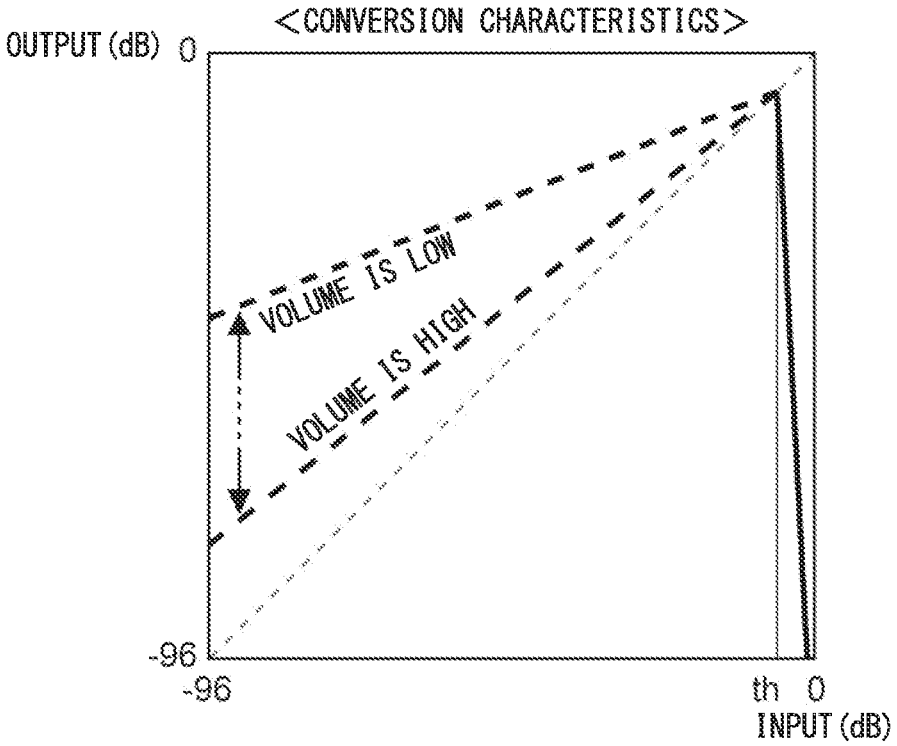
FIG. 4 is a graph illustrating the input and output characteristics of the conversion unit of the voice clarification apparatus according to the second embodiment of the present invention.

The conversion characteristic of the conversion unit 306 may be configured to change according to volume. That is, as shown in FIG. 3, configuration may be made such that the setting information Vol of a volume 312, which is used to set volume, is supplied to the conversion unit 306, and the conversion unit 306 changes the conversion characteristic according to the setting information Vol. As the conversion characteristic, for example, as shown in FIG. 4, a characteristic, in which an output level is raised in a region in which an input level is equal to or less than the threshold th, is secured. When setting is made such that the setting information Vol causes volume to be turned down, a gain is relatively increased by reducing a slope of the curve of the conversion characteristic such that the gain causes a ratio of the input level to the output level to be great. Meanwhile, when a setting is made such that the setting information Vol causes volume to be turned up, a gain is relatively reduced by increasing the slope of the curve of the conversion characteristic.

If low volume is set, the volume of an audio signal In is turned down. At this time, when the number of voice components included in the audio signal In is small, clarity is low compared to the reproduction in normal volume. In this case, if it is configured such that the conversion characteristic of the conversion unit 306 changes according to the setting information Vol, the gain Ka which is the degree of emphasis of voice is raised according to the setting information Vol compared to the embodiment, and thus voices can be further clarified.

In addition, the setting information Vol may be set by a remote controller in addition to the volume 312. Further, the conversion characteristic corresponding to volume is not limited to FIG. 4. For example, a setting may be made such that the threshold th which has the input and output characteristics shown in FIG. 2 reduces as the volume is turned up, and that the threshold th increases as the volume is turned down. When the volume is sufficiently high, the clarity of voice is not a problem. Therefore, in this case, the audio signal In can be output as it is if possible. However, when the volume is low, there are many cases in which voices are unclear. Therefore, the voice components can be emphasized if possible.

In the first embodiment, the gain coefficients of the multipliers 212, 222, and 232 are fixed. However, as shown in FIG. 3, a configuration, in which a setting unit 14 and a storage unit 15 are added such that the gain coefficients are switched depending on various types of modes, may be used.

In this configuration, for example, as shown in FIG. 5, a set of gain coefficients K1, K2, and K3 is stored in the storage unit 15 in advance for each of the plurality of modes. When the setting unit 14 receives the supply of information Sel, which defines a mode, from a high-ranking apparatus, the setting unit 14 selects a coefficient set corresponding to the mode of the information Sel, reads the coefficient set from the storage unit 15, and supplies the gain coefficient K1 to the multiplier 212, the gain coefficient K2 to the multiplier 222, and the gain coefficient K3 to the multiplier 232, respectively.

For example, when a mode 13 is selected by the information Sel, the setting unit 14 reads the gain coefficients k1*b*, k2*b*, and k3*b* which correspond to the mode from the storage unit, and supplies the respective coefficients to the multiplier 212 as the gain coefficient K1, to the multiplier 222 as the gain coefficient K2, and to the multiplier 232 as the gain coefficient K3.

Here, if coefficients which satisfy K1<K2 and K1<K3 are stored in the storage unit 15 as an arbitrary mode, it is possible to emphasize the higher pass component of the voice components more than the lower pass component thereof when the mode is selected. Further, if coefficients which satisfy K1>K3 and K2>K3 are stored in the storage unit 15 as another mode, it is possible to emphasize the lower pass component of the voice components more than the higher pass component thereof when the mode is selected. That is, it is possible to select a gain coefficient set which makes a tone according to the preference of a listener.

Third Embodiment

Figure 6:
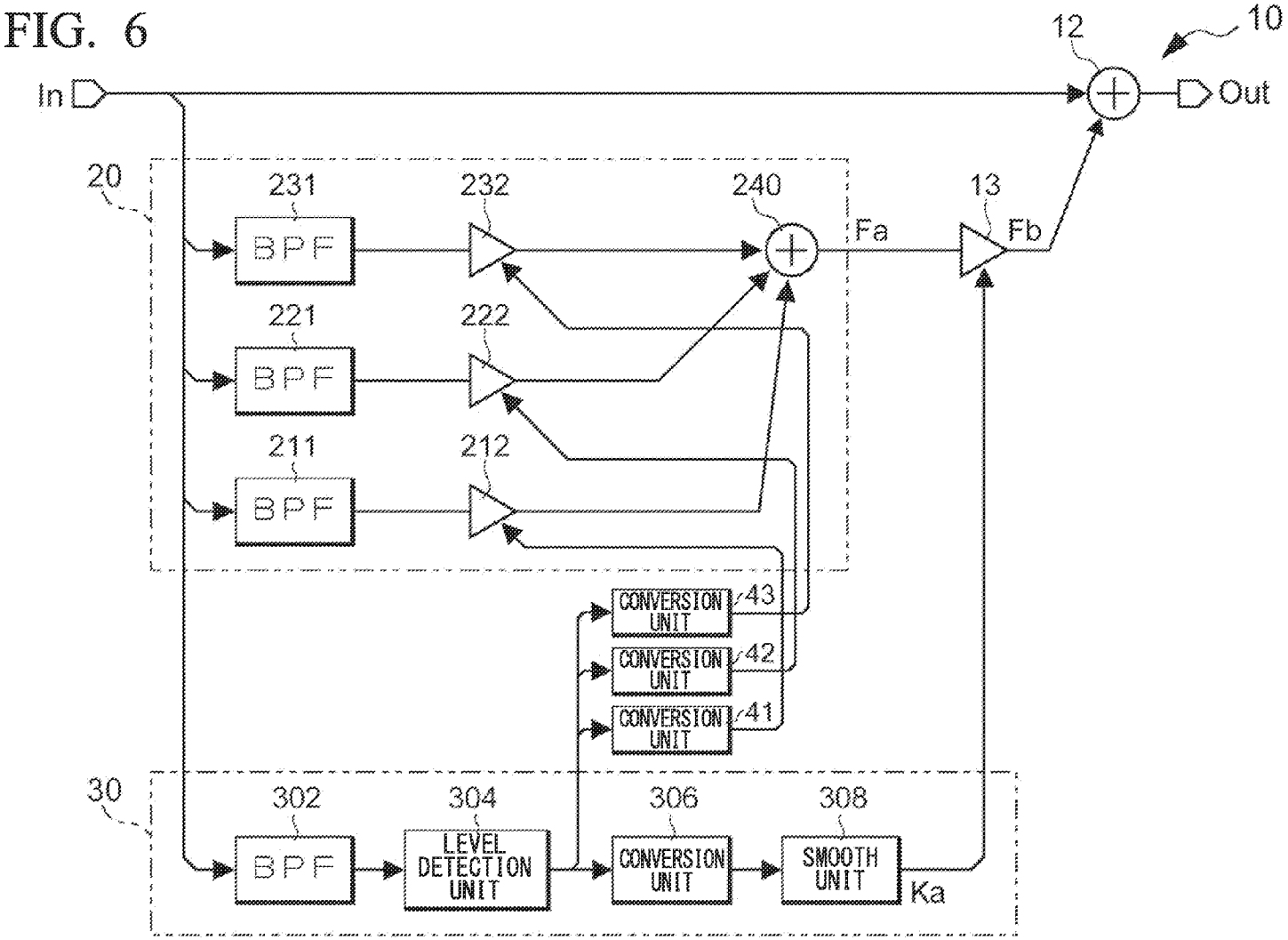
FIG. 6 is a block diagram illustrating a voice clarification apparatus according to a third embodiment of the present invention.

In the above-described embodiment, the gain coefficients of the multipliers 212, 222, and 232 are fixed. However, an aspect in which the values of the respective gain coefficients changes depending on input levels may be used. More specifically, as shown in FIG. 6, a configuration in which conversion units 41, 42, and 43 are provided to correspond to the respective multipliers 212, 222, and 232, and in which the conversion units 41, 42, and 43 supply respective gain coefficients may be used.

Here, the conversion units 41, 42, and 43 convert the level of the signal which is output from the level detection unit 304 into gain coefficients like the conversion unit 306. The input and output characteristics of the conversion units 41, 42, and 43 may be appropriately set according to the preference of a listener. With such a configuration, since each of the gains of the output signals of the BPFs changes and is set according to the volume of the voice included in the input audio signal In, it is possible to cause a tone which matches the preference of a listener.

In addition, here, level adjustment is performed on both sides, that is, the multipliers 212, 222, and 232 which are provided on the outputs of the respective BPFs and the multiplier 13 which is processed with respect to the signal Fa obtained after addition is performed. However, it is possible to omit the process performed by the multiplier 13.

Fourth Embodiment

Figure 7:
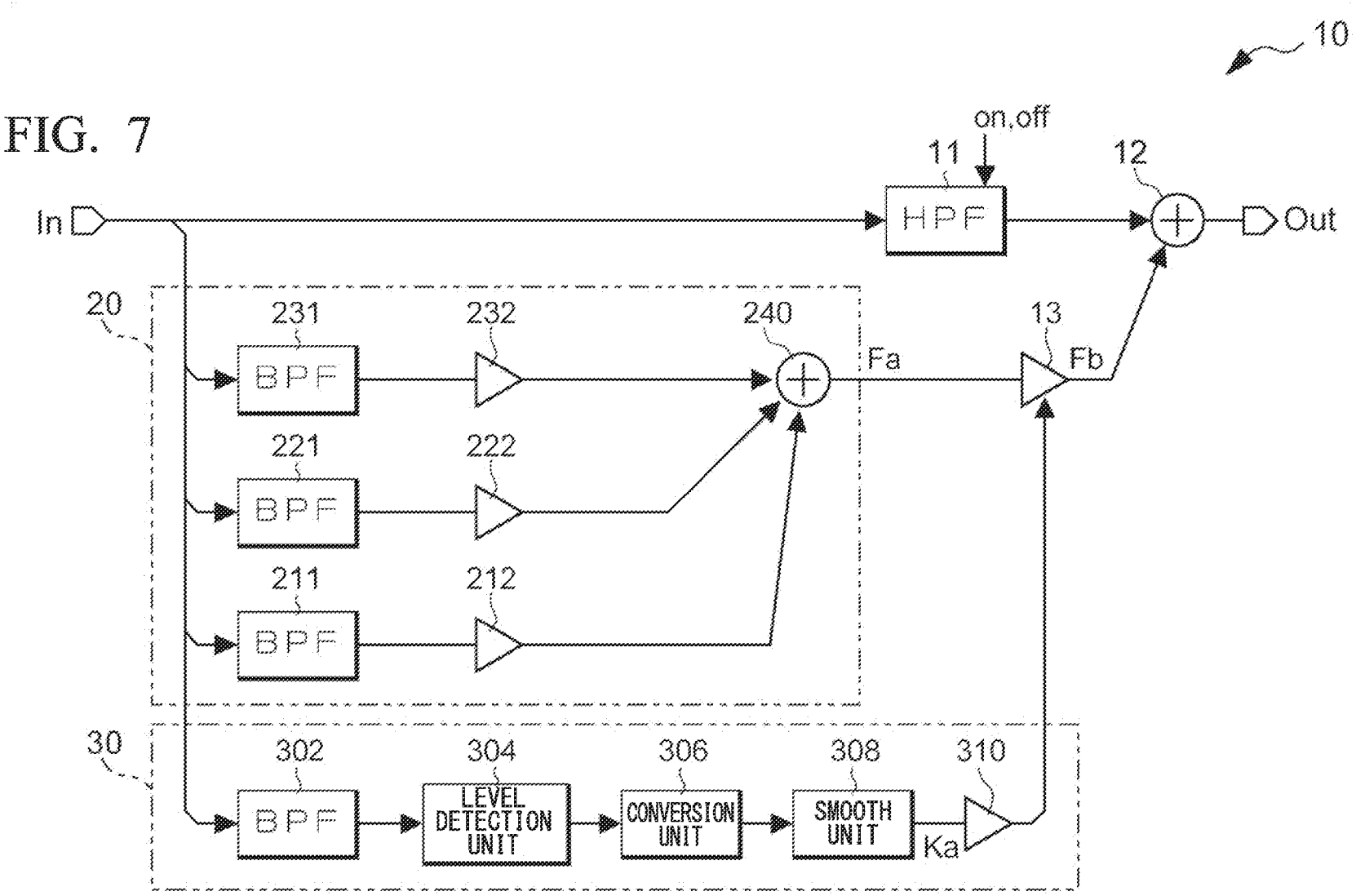
FIG. 7 is a block diagram illustrating a voice clarification apparatus according to a fourth embodiment of the present invention.

As shown in FIG. 7, a High Pass Filter (HPF) 11 which cuts the low pass side of the audio signal In and supplies a resulting audio signal to an input terminal of one side of the adder 12 may be provided. In addition, the cut-off frequency of the HPF 11 is, for example, 40 Hz.

Further, as shown in the same drawing, the HPF 11 may be configured to have on and off functions such that the low pass side of the audio signal In is cut in the case of the on function, and the audio signal In is bypassed and a resulting audio signal is supplied to the input terminal of the one side of the adder 12 in the case of the off function.

Therefore, to one side of the input terminals of the adder 12, the audio signal In may be supplied and a signal, obtained by filtering the audio signal In by the HPF 11, may be supplied. That is, the signal based on the audio signal includes the audio signal itself in addition to the signal obtained by filtering the audio signal.

As shown in FIG. 7, in order to perform fine adjustment of the gain Ka which is output from the smoothing unit 308, an operation unit 310 which performs an operation such as a multiplication of a fixed value may be provided. In addition, the operation unit 310 is not limited to performing a multiplication but may perform addition and subtraction, division, or an appropriate combination thereof.

Fifth Embodiment

Figure 8:
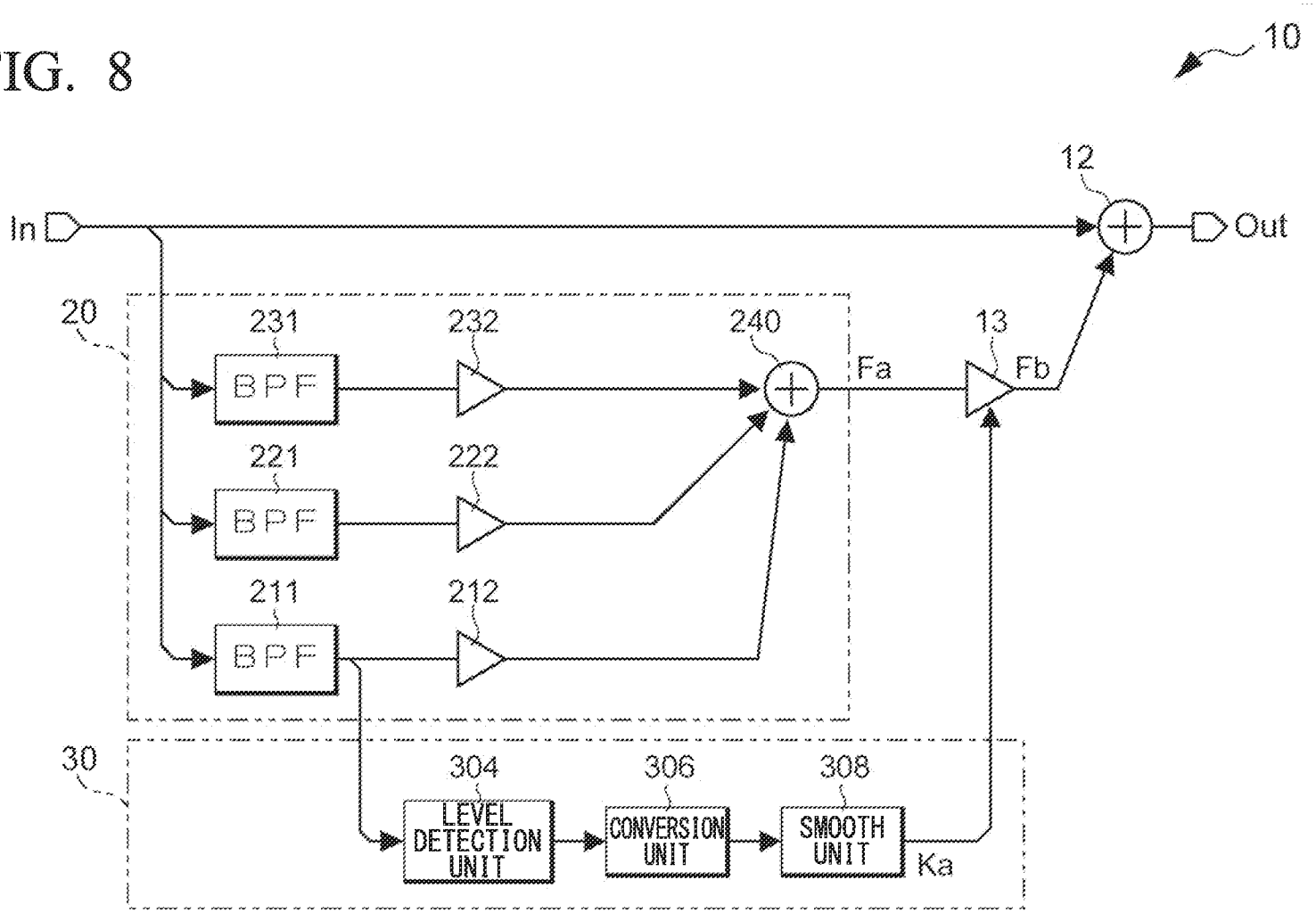
FIG. 8 is a block diagram illustrating a voice clarification apparatus according to a fifth embodiment of the present invention.

In the above-described embodiment, the gain determination unit 30 uses the output signal of the BPF 302 as the signal indicative of the volume of the voice component. However, the first formant component which is the output of the BPF 211 may be substituted for the signal. More specifically, as shown in FIG. 8, a configuration in which the output of the BPF 211 is supplied to the multiplier 212 and the level detection unit 304 may be used. According to this configuration, since it is possible to omit a single BPF, it is possible to simplify the configuration.

The voice clarification apparatuses shown in FIGS. 1, 3, 6, 7, and 8 are realized in such a way that a program in which a predetermined process is described is written in a microcomputer (a Digital Signal Processor (DSP) device) having a DSP function. More specifically, the function of the voice clarification apparatus 1 can be implemented in such a way that a program, in which a process such as the high band pass process (the HPF 11), the band pass process (BPFs 211, 221, 231, and 302), the low band pass process (the smoothing unit 308), the multiplication process (multipliers 13, 212, 222, 232, and 310), or the addition process (the adder 12, 240) is written, is described on the DSP device.

Therefore, the present invention may be expressed as a signal processing method and a program which causes a computer to function as the voice clarification apparatus.

While preferred embodiments of the invention have been described and illustrated above, it should be understood that these are exemplary of the invention and are not to be considered as limiting. Additions, omissions, substitutions, and other modifications can be made without departing from the spirit or scope of the present invention. Accordingly, the invention is not to be considered as being limited by the foregoing description, and is only limited by the scope of the appended claims.

What is claimed is:

1. A voice clarification apparatus comprising:

a microcomputer;

a memory including a program;

a plurality of band-pass filters that respectively extract a plurality of band components, which are included in a voice band, from an input audio signal to output a plurality of feedforward, extracted band components;

a gain determination unit that determines a gain according to a level of a signal of a band component which is extracted by a band-pass filter;

a level adjustment unit that adjusts levels of signals of the plurality of feedforward, extracted band components using the gain; and a first addition unit that adds a signal which is based on the input audio signal to a signal including the adjusted levels of signals of the plurality of feedforward, extracted band components and excluding any feedback components of the extracted band components, and outputs a signal obtained through the addition, wherein the plurality of band-pass filters, the gain determination unit, the level addition unit, and the first addition unit are implemented by the microcomputer executing the program.

2. The voice clarification apparatus according to claim 1, wherein the gain determination unit includes a conversion unit which converts input levels based on a signal indicative of voice components into a gain which has predetermined input and output characteristics, wherein the conversion unit outputs the gain which is greater than "1" when an absolute value of a level of the signal indicative of the voice components is equal to or less than a threshold, and outputs the gain which is smaller than "1" when the absolute value is greater than the threshold, and wherein the conversion unit is implemented by the microcomputer executing the program.

3. The voice clarification apparatus according to claim 2, wherein the conversion unit changes the input and output characteristics according to setting information which is used to set volume.

4. The voice clarification apparatus according to claim 1, wherein the plurality of band-pass filters include a first band-pass filter which extracts a first frequency band included in the voice band of the input audio signal, and a second band-pass filter which extracts a second frequency band which is higher than the first frequency band in the voice band of the input audio signal, and wherein the voice clarification apparatus further includes:

a first multiplier that multiplies a level of a signal extracted by the first band-pass filter by a first gain coefficient;

a second multiplier that multiplies a level of a signal extracted by the second band-pass filter by a second gain coefficient; and a second addition unit that adds the signal which is output from the first multiplier to the signal which is output from the second multiplier, and outputs a resulting signal, and wherein the first multiplier, the second multiplier, and the second addition unit are implemented by the microcomputer executing the program.

5. The voice clarification apparatus according to claim 4, further comprising:

a storage unit that stores a plurality of sets of the first gain coefficient and the second gain coefficient in advance; and a setting unit that selects any one of the plurality of sets, and supplies a first gain coefficient of the selected set to the first multiplier, and a second gain coefficient of the selected set to the second multiplier, wherein the storage unit and the setting unit are implemented by the microcomputer executing the program.

6. The voice clarification apparatus according to claim 4, further comprising:

a first conversion unit and a second conversion unit that respectively determine the first gain coefficient and the second gain coefficient according to a level of a signal of a band component which is extracted by the band-pass filter used by the gain determination unit, wherein the first conversion unit and the second conversion unit are implemented by the microcomputer executing the program.

7. A voice clarification method comprising:

respectively extracting a plurality of band components, which are included in a voice band, from an input audio signal by a plurality of band-pass filters to output a plurality of feedforward, extracted band components;

determining a gain according to a level of a signal of a band component which is extracted by a band-pass filter;

adjusting levels of signals of the plurality of feedforward, extracted band components using the gain; and adding a signal which is based on the input audio signal to a signal including the adjusted levels of signals of the plurality of feedforward, extracted band components and excluding any feedback components of the extracted band components, and outputting a signal obtained through the addition.

8. The voice clarification apparatus according to claim 1, wherein the band-pass filter of the gain determination unit is one of the plurality of band-pass filters.

9. The voice clarification apparatus according to claim 1, wherein the band component extracted by the band-pass filter of the gain determination unit differs from each of the plurality of band components extracted by the plurality of band-pass filters.

* * * * *